US010196166B2

(12) United States Patent
Cooper

(10) Patent No.: US 10,196,166 B2
(45) Date of Patent: Feb. 5, 2019

(54) METHOD OF PENETRATING MATERIAL WITH A FASTENER DISPENSING NEEDLE

(71) Applicant: Avery Dennison Retail Information Services, LLC, Westborough, MA (US)

(72) Inventor: William J. Cooper, Shrewsbury, MA (US)

(73) Assignee: Avery Dennison Corporation, Glendale, CA (US)

( * ) Notice: Subject to any disclaimer, the term of this patent is extended or adjusted under 35 U.S.C. 154(b) by 305 days.

(21) Appl. No.: 15/296,843

(22) Filed: Oct. 18, 2016

(65) Prior Publication Data

US 2018/0105310 A1 Apr. 19, 2018

(51) Int. Cl.
*B65C 7/00* (2006.01)
*G09F 3/08* (2006.01)
*D05B 69/00* (2006.01)

(52) U.S. Cl.
CPC ..... *B65C 7/003* (2013.01); *D05B 69/00* (2013.01); *G09F 3/08* (2013.01)

(58) Field of Classification Search
CPC ... Y10T 29/481; Y10T 29/482; Y10T 29/483; Y10T 29/484; Y10T 29/49947;
(Continued)

(56) References Cited

U.S. PATENT DOCUMENTS 3,792,675 A 2/1974 Kuromegawa
3,872,806 A 3/1975 Bone
(Continued)

FOREIGN PATENT DOCUMENTS

CN 2769287 4/2006
CN 105463716 4/2016
(Continued)

OTHER PUBLICATIONS

International Search Report and Written Opinion issued in corresponding IA No. PCT/US 2017/056879 dated Jan. 26, 2018.
(Continued)

*Primary Examiner* — Jason L Vaughan
*Assistant Examiner* — Amanda J Meneghini
(74) *Attorney, Agent, or Firm* — Avery Dennison Corporation

(57) ABSTRACT

A method for penetrating a material with a fastener dispensing needle includes the steps of partially penetrating the material using a first penetration stroke, partially withdrawing the needle from the material using a first withdrawal stroke and, in turn, fully penetrating the material using a second penetration stroke. Once fully penetrated, a plastic fastener is dispensed from the fastener dispensing needle. Thereafter, the fastener dispensing needle is fully withdrawn from the material. Additional partial penetration and withdrawal strokes could be incorporated into the needle penetration cycle in a repeating pattern, as needed, with each penetration stroke preferably having a stroke length which is twice the length of each withdrawal stroke. The use of an oscillating, back-and-forth, linear needle penetration cycle serves to minimize the risk of lateral needle deflection which can result in bending or breakage of the needle as well as damage to the penetrated material.

15 Claims, 6 Drawing Sheets

(58) Field of Classification Search
CPC ..... Y10T 29/49954; Y10T 29/49956; Y10T 29/49957; Y10T 29/49959; Y10T 29/49961
USPC ..... 227/67, 71
See application file for complete search history.

(56) References Cited

U.S. PATENT DOCUMENTS

| | | | | |
|---|---|---|---|---|
| 4,039,078 | A | 8/1977 | Bone | |
| 4,286,532 | A | 9/1981 | Tonomura | |
| 4,628,846 | A | 12/1986 | Vives | |
| 5,669,543 | A * | 9/1997 | Ueno | B65C 7/003 112/222 |
| 6,267,285 | B1 * | 7/2001 | Raymond | B29C 45/26 227/67 |
| 6,837,172 | B1 | 1/2005 | Jung | |
| 8,413,866 | B2 | 4/2013 | Cooper et al. | |
| 2002/0017227 | A1 | 2/2002 | Ochi | |

FOREIGN PATENT DOCUMENTS

| | | |
|---|---|---|
| DE | 19545865 | 6/1996 |
| EP | 2568069 | 3/2013 |
| EP | 3038932 | 7/2016 |
| WO | 00/51792 | 9/2000 |
| WO | 2006/102774 | 10/2006 |

OTHER PUBLICATIONS http://www.stularplus.com/product/tagging-guns/fine-pistol-grip-tools/banok-503xl-fine-tagging-gun-with-extra-long-needle-11-503xl/.
"Sewing through Many Thick Layers of Fabric." Sacôtin, Sacôtin, Apr. 16, 2016, sacotin.com/en/sewing-through-several-thick-layers/.

* cited by examiner

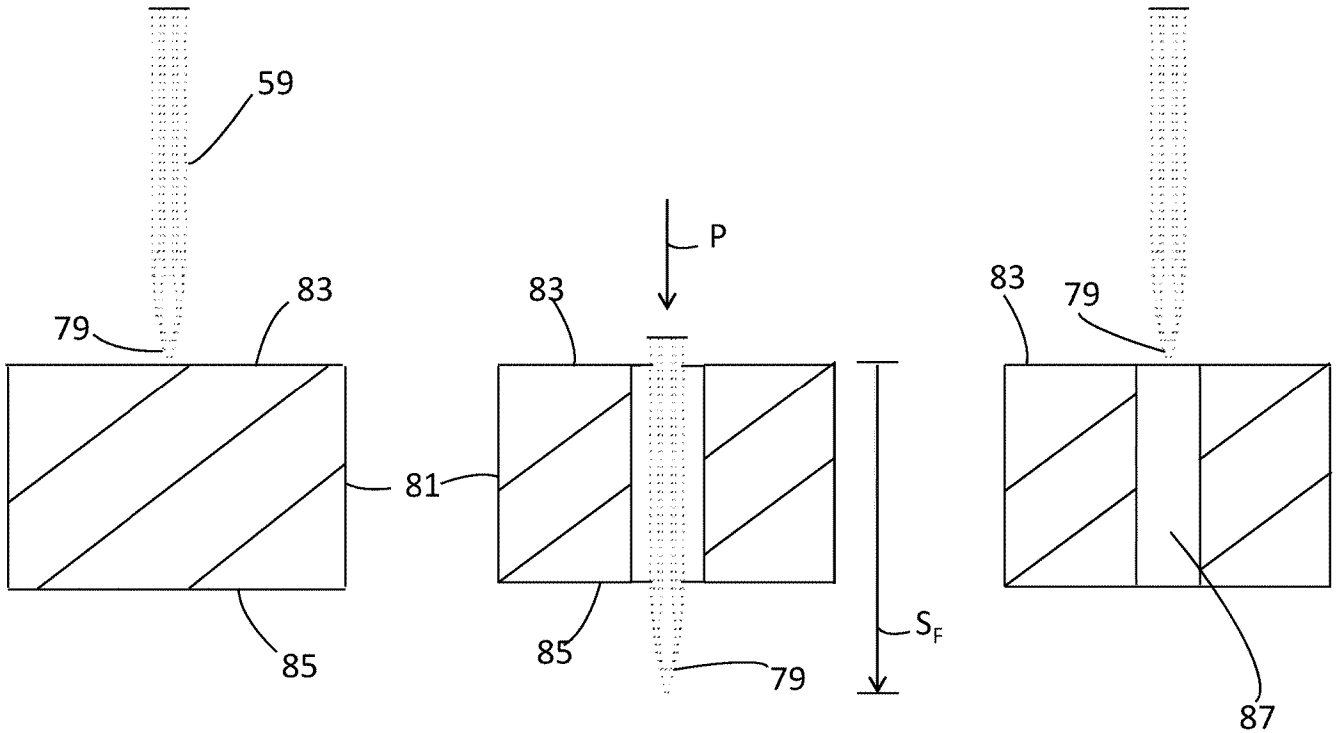
Prior Art Fig. 4(a)
Prior Art Fig. 4(b)
Prior Art Fig. 4(c)

METHOD OF PENETRATING MATERIAL WITH A FASTENER DISPENSING NEEDLE

FIELD OF THE INVENTION

The present invention relates generally to the retail industry and more particularly to plastic fasteners used in the retail industry.

BACKGROUND OF THE INVENTION

Plastic fasteners are commonly utilized in the retail industry in a variety of different applications to couple together two or more separate items. For instance, plastic fasteners are often used to couple together (i) a pair of complementary articles of clothing, such as socks, gloves and the like, (ii) a merchandise tag, or ticket, to one or more articles of clothing (e.g., a merchandise ticket folded over the waistline of a pair of jeans), and (iii) a handheld item (e.g., a tool or toy) to its corresponding packaging (e.g., a screwdriver disposed against the front surface of a flat, cardboard display card).

In U.S. Pat. No. 4,039,078 to A. R. Bone, the disclosure of which is incorporated herein by reference, there are disclosed several different types of plastic fasteners. Each plastic fastener described in the patent is manufactured in a generally H-shaped configuration, with two shortened parallel cross-bars, or T-bars, being interconnected at their appropriate midpoints by a single, thin, flexible filament which extends orthogonally therebetween.

Plastic fasteners of the type described above are commonly fabricated as part of a continuously connected supply of fastener stock, which is also commonly referred to in the art simply as ladder stock due to its ladder-like appearance. Referring now to FIG. 1, there is shown a length of ladder stock that is presently manufactured and sold by Avery Dennison Corporation of Pasadena, Calif. under the PLASTIC STAPLE® and ELASTIC STAPLE™ lines of plastic fasteners. As can be seen, a length of ladder stock is shown that is preferably produced from one or more flexible plastic materials, such as nylon, polypropylene and the like, the ladder stock being identified generally by reference numeral 11. Ladder stock 11 comprises a pair of elongated and continuous side members, or rails, 13 and 15 which are interconnected by a plurality of equidistantly spaced cross-links 17.

An individual plastic fastener 18 is obtained from ladder stock 11 by severing side members 13 and 15 at the approximate midpoint between successive cross-links 17. As can be seen, each fastener 18 comprises a pair of cross-bars 19 and 21 which are interconnected by a thin, flexible filament 23, with cross-bars 19 and 21 comprising sections of side members 13 and 15, respectively, and filament 23 comprising a cross-link 17.

Automated plastic fastener dispensing devices, or machines, are well known in the art and are commonly used to dispense individual plastic fasteners from a reel of ladder-type fastener stock. For example, in U.S. Pat. No. 8,413,866 to W. J. Cooper et al., the disclosure of which is incorporated herein by reference, there is disclosed one well known type of plastic fastener dispensing device that is presently manufactured and sold by Avery Dennison Corporation of Pasadena, Calif. as the ST9500® fastener system, the fastener dispensing device being shown in FIG. 2 and identified therein by reference numeral 30. As can be seen, fastener dispensing device 30 is designed to dispense individual plastic fasteners from a reel of continuously-connected ladder stock 11.

Fastener dispensing device, or machine, 30 comprises a substantially enclosed, protective housing 39 that serves to protect the majority of the electrical and mechanical components for device 30. An arcuate recess 41 is formed in the top surface of housing 39. A cylindrical reel holder 43, which is mounted onto housing 39, extends laterally through recess 41 and is dimensioned to pass axially through a longitudinal bore formed in a reel, or spool, 45 around which ladder stock 11 is wound. Accordingly, holder 43 serves to support reel 45 within recess 41 and enable reel 45 to rotate freely during normal operation, thereby rendering device 10 capable of continuously dispensing plastic fasteners in an automated fashion.

Fastener dispensing device 30 additionally includes a motor-driven head assembly 53 that is disposed within the front end of protective housing 39 and is responsible for, inter alia, dispensing an individual fastener 18 from ladder stock 11. Specifically, head assembly 53 includes a vertically extending mount 55 that is fixedly retained in place, mount 55 being generally U-shaped in lateral cross-section. A motor-driven, vertically displaceable head 57 is slidably coupled to mount 55 for purposes to become apparent below.

Head assembly 53 comprises a pair of hollow, slotted needles 59-1 and 59-2 that is fixedly coupled to vertically displaceable head 57 and is therefore adapted to selectively penetrate through the one or more items to be fastened, a feed mechanism 61 for advancing side members 13 and 15 of ladder stock 11 into axial alignment behind the longitudinal bores defined by needles 59-1 and 59-2, respectively, a severing mechanism 63 for cutting side members 13 and 15 of ladder stock 11 at the approximate midpoint between successive cross-links 17 to separate an individual plastic fastener 18 from the remainder of ladder stock 11, and an ejection mechanism 65 for ejecting cross-bars 19 and 21 of the severed fastener 18 through the bores of the pair of hollowed needles 59 and, in turn, through the one or more items previously penetrated by needles 59.

Referring now to FIGS. 3(*a*)-(*c*), there are shown front perspective, top plan and front plan views, respectively, of fastener dispensing needle 59. As can be seen, needle 59 comprises an elongated, generally cylindrical, slotted stem 71 that is hollowed out along its length so as to define a longitudinal bore 73. Stem 71 includes a trailing end, or base, 75, which is appropriately dimensioned for mounting within head 57, and a spoon-shaped leading end 77 with a sharpened tip 79 designed to facilitate penetration through the desired articles. As can be appreciated, bore 73 is sized and shaped to axially receive a cross-bar (e.g., either cross-bar 19 or cross-bar 21) of fastener 31, thereby enabling the cross-bar to be inserted into bore 73 from trailing end 75, travel axially therethrough along its length, and ultimately exit from bore 73 through open leading end 77.

As referenced above, each fastener dispensing needle 59 is vertically driven by head 57 and designed to selectively penetrate through the one or more items to be fastened during the dispensing process. Referring now to FIGS. 4(*a*)-(*c*), there is shown a series of views depicting a conventional method in which each fastener dispensing needle 59 penetrates through material 81 during normal operation of a fastener dispensing machine (e.g., prior art machine 30). For simplicity purposes, material 81 is represented herein as a single layer of fabric which includes a first, or top, surface 83 and a second, or bottom, surface 85.

As seen in FIG. 4(*a*), needle 59 is oriented vertically downward with sharpened tip 79 positioned close in relation to first surface 83. Through motorized displacement of head 57, each needle 59 is driven vertically downward so as to penetrate material 81, as represented by arrow P in FIG. 4(*b*). As can be seen, the forward stroke $S_F$ of needle 59 extends from first surface 83 (or in close proximity thereto) to slightly beyond opposing surface 85 (i.e., with enough clearance that the fastener cross-bar can exit bore 73).

Upon ejection of the fastener cross-bar through needle 59 and, as such, through material 81, needle 59 is withdrawn from material 81, as represented by arrow W in FIG. 4(*c*). As can be seen, the rearward stroke $S_R$ of needle 59 extends from slightly beyond surface 85 back to surface 83 (or in close proximity thereto). With needle 59 withdrawn, a hole 87 typically remains in material 81 due to the needle penetration process.

Accordingly, in summation, the penetration cycle for needle 59 consists of a single forward stroke $S_F$ that extends through the entirety of material 81 and a single rearward stroke $S_R$ that completely withdraws needle 59 from material 81. As can be appreciated, fastener dispensing devices that utilize a needle penetration cycle as set forth above have been found to experience a notable shortcoming.

Specifically, it has been found that needle 59 is prone to lateral deflection using the above-described penetration cycle, particularly when material 81 is of a considerable thickness and/or density. Lateral deflection of needle 59 away from its ideal linear penetration path can result in either (i) permanent bending or breakage of needle 59 and/or (ii) significant widening of hole 87, which often results in notable damage to material 81.

SUMMARY OF THE INVENTION

It is an object of the present invention to provide a new and improved method for dispensing a plastic fastener through material.

It is another object of the present invention to provide a method for dispensing a plastic fastener through material using a machine with at least one fastener dispensing needle.

It is yet another object of the present invention to provide a method as described above wherein the at least one fastener dispensing needle is designed to penetrate through the material in an optimal manner.

It is still another object of the present invention to provide a method as described above wherein the at least one fastener dispensing needle is designed to penetrate through the material in such a manner so as to impart minimal damage to the needle or to the material.

Accordingly, as one feature of the present invention, there is provided a method for penetrating a material with a fastener dispensing needle, the material having a first surface and an opposing second surface, the fastener dispensing needle having a leading end with a sharpened tip, the method comprising the steps of (a) partially penetrating the material with the fastener dispensing needle using a first penetration stroke, (b) after the partial penetration step, partially withdrawing the fastener dispensing needle from the material using a first withdrawal stroke, and (c) after the partial withdrawal step, fully penetrating the material with the fastener dispensing needle using a second penetration stroke.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIGS. 4(*a*)-(*c*) are a series of front views depicting a conventional method in which the needle shown in FIG. 3(*c*) penetrates through material during normal operation of a fastener dispensing machine, the material being shown in section.

DETAILED DESCRIPTION OF THE INVENTION

Figure 1:
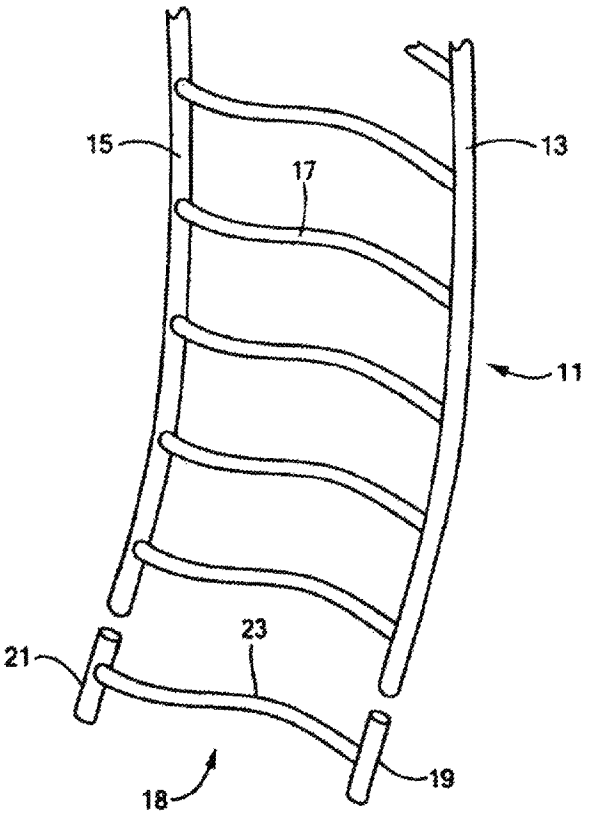
Prior Art Fig. 1
FIG. 1 is a fragmentary, front perspective view of a length of continuously connected ladder stock that is known in the art, the ladder stock being shown with an individual plastic fastener separated therefrom.
Figure 2:
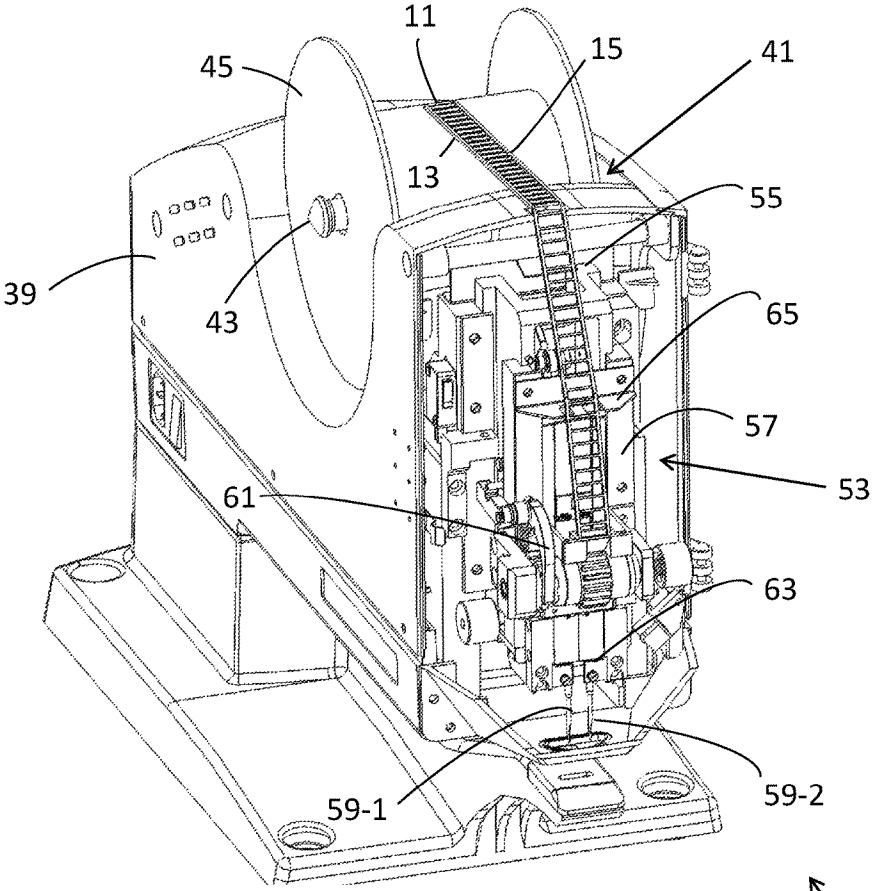
Prior Art Fig. 2
FIG. 2 is a front perspective view of a fastener dispensing device that is known in the art, the fastener dispensing device being shown with a length of the fastener stock in FIG. 1 fed thereinto, the fastener dispensing device being shown with a portion of its housing removed therefrom.
Figure 3A:
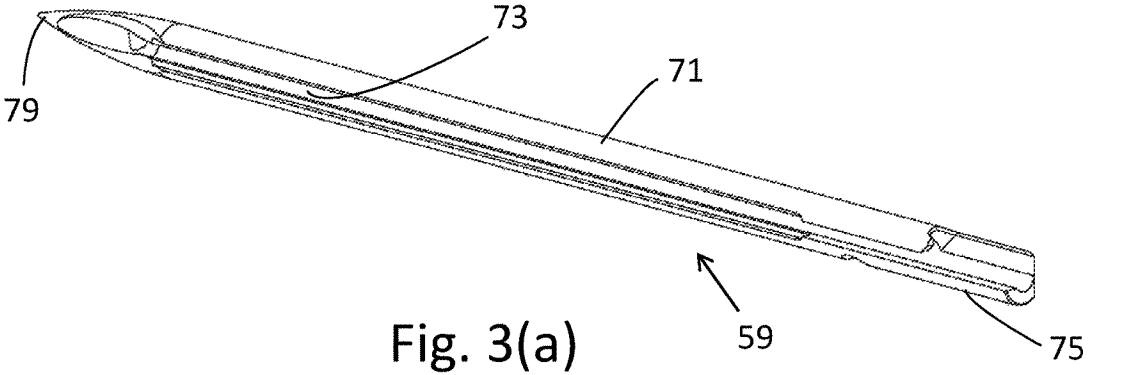
FIGS. 3(*a*)-(*c*) are enlarged front perspective, top plan, and front plan views, respectively, of the fastener dispensing needle shown in FIG. 2.
Figure 3B:
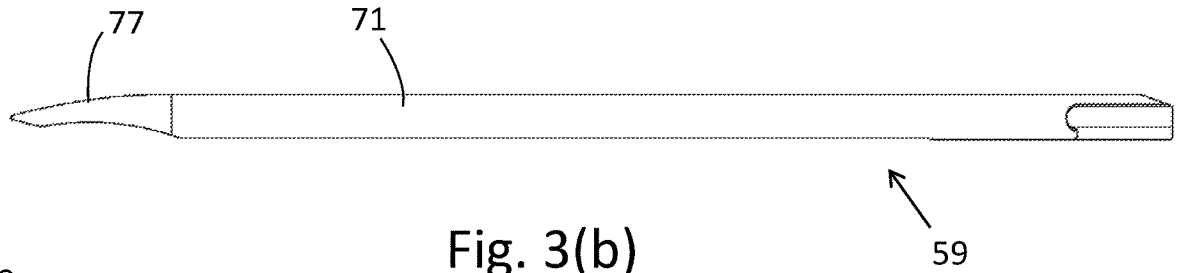
Figure 3C:
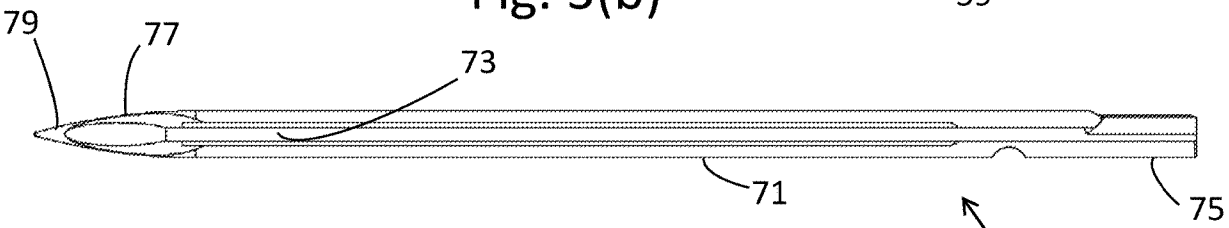
Figure 5C:
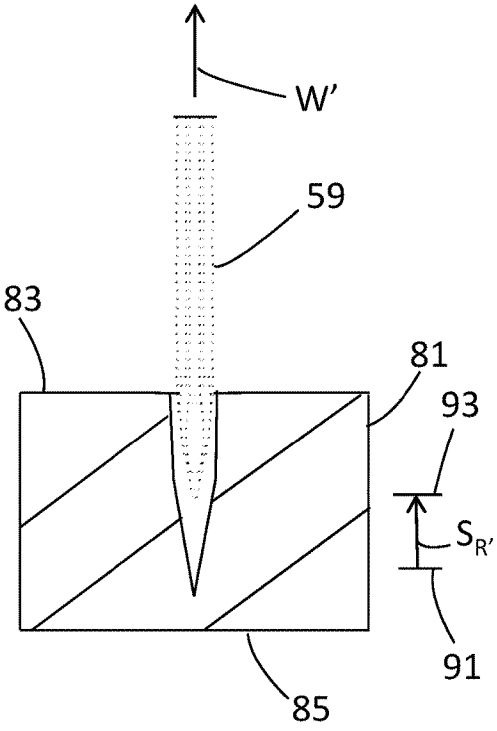
FIGS. 5(*a*)-(*e*) are a series of front views depicting a novel method in which the needle shown in FIG. 3(*c*) penetrates through material during operation of a fastener dispensing machine, the method being taught in accordance with the teachings of the present invention, the material being shown in section.
Figure 5B:
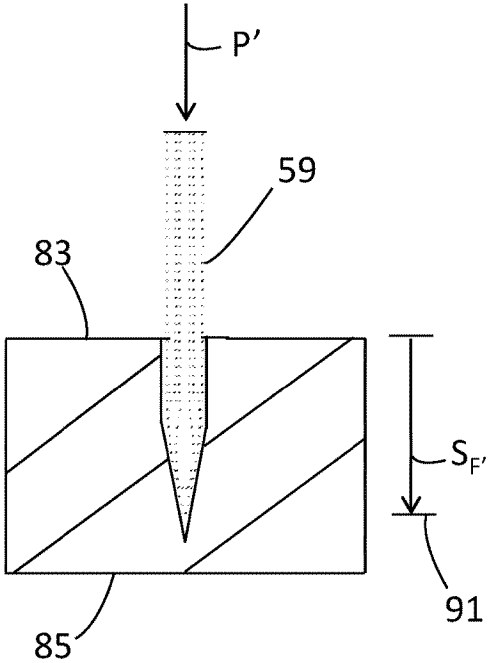
Figure 5A:
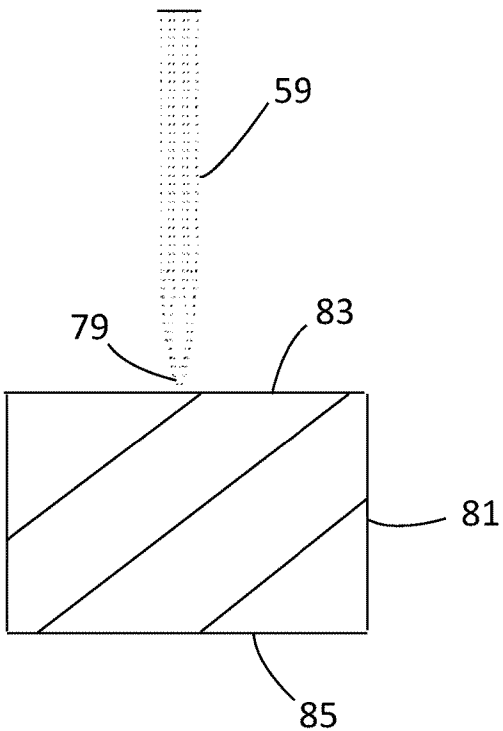
Figure 5E:
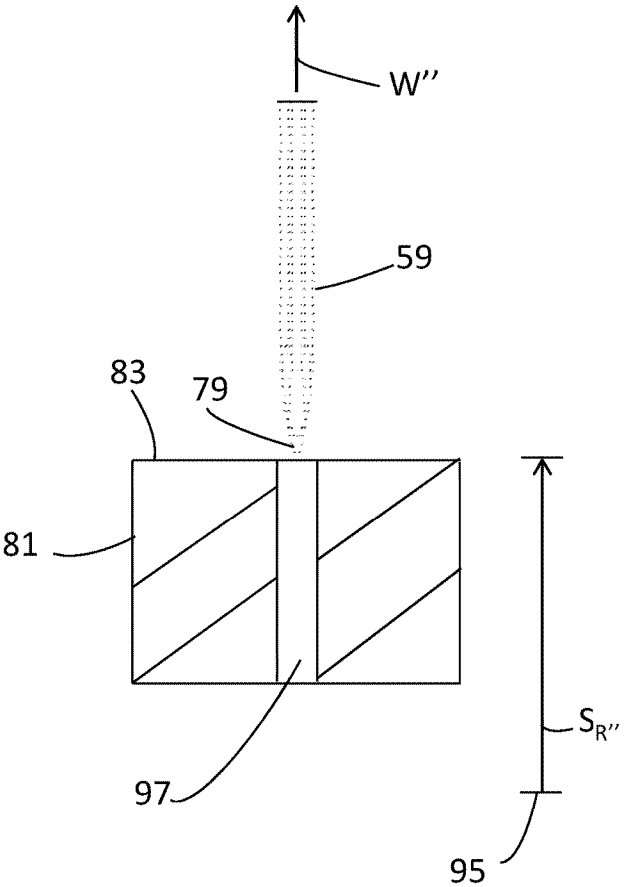
Figure 5D:
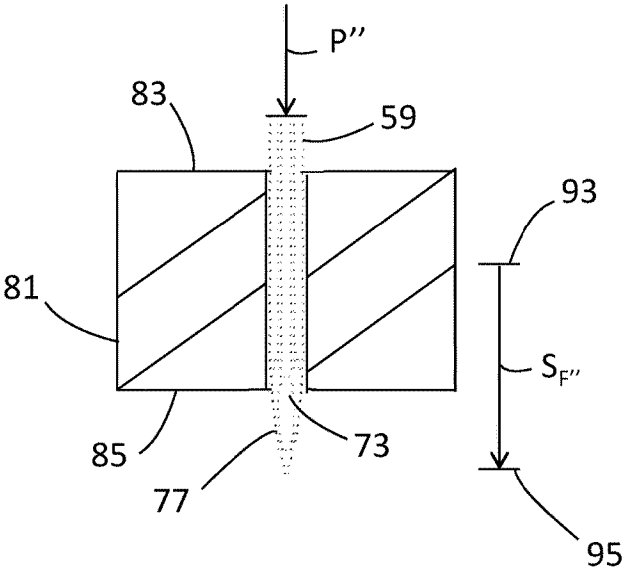

Referring now to FIGS. 5(*a*)-(*e*), there is shown a series of views depicting a novel method for penetrating a material 81 with a fastener dispensing needle 59, the method being taught in accordance with the teachings of the present invention. As will be explained in detail below, in the method of the present invention, needle 59 is penetrated through material 81 using an oscillating, or reciprocating, linear penetration cycle in order to minimize the risk of damage to the needle or to the material.

As defined herein, material 81 represents any substance that is commonly applied, or otherwise tagged, with a plastic fastener, such as clothing fabrics, cardboard display cards, paper-based merchandise tags and the like. Further, it should be noted that material 81 is represented herein as a single layer for simplicity purposes only. However, it is to be understood that material 81 may represent multiple layers of material that are intended to be secured together using a plastic fastener, such as prior art fastener 18.

Additionally, in the description that follows, the method of the present invention is described in connection with the penetration of material 81 using a single fastener dispensing needle 59. However, it should be noted that the method of the present invention is not limited to needle 59, but rather could be utilized with other types of needles that are commonly used in fastener dispensing applications. Additionally, it is to be understood that the method of the present invention could be similarly applied to fastener dispensing machines which include multiple needles 59 (e.g., fastener dispensing machine 30) using the principles explained in detail below.

Referring now to FIG. 5(*a*), in the first step of the needle penetration method of the present invention, needle 59 is oriented vertically downward with sharpened tip 79 positioned close in relation to first surface 83. Through motorized displacement of head 57, each needle 59 is driven linearly downward so as to partially penetrate material 81, as represented by arrow P' in FIG. 5(*b*). As can be seen, partial penetration stroke $S_{F'}$ of needle 59 extends from first surface 83 (or in close proximity thereto) to a first location 91 in material 81 between first surface 83 and second surface 85.

Immediately thereafter, each needle 59 is partially withdrawn from material 81 along the same linear path, as represented by arrow W' in FIG. 5(*c*). As can be seen, partial withdrawal stroke $S_{R'}$ of needle 59 extends from first location 91 to a second location 93 in material 81 between first surface 83 and first location 91.

Upon completion of the partial withdrawal step, each needle 59 is driven linearly downward along the same linear path so as to fully penetrate material 81, as represented by arrow P" in FIG. 5(*d*). As can be seen, full penetration stroke $S_{F''}$ of needle 59 extends from second location 93 to a third location 95 disposed slightly beyond opposing surface 85 (i.e., with enough clearance that a fastener cross-bar can exit bore 73 though leading end 77).

Preferably, the length of full penetration stroke $S_{F''}$ is approximately equal to partial penetration stroke $S_{F'}$. In this manner, a needle penetration cycle with a common, or fixed, forward stroke can be easily implemented into a fastener dispensing system.

Upon ejection of the fastener cross-bar through leading end 77 of needle 59 and, as such, through material 81, needle 59 is fully withdrawn from material 81, as represented by arrow W" in FIG. 5(*e*). As can be seen, full withdrawal stroke $S_{R'}$ of needle 59 extends from third location 95 (i.e., slightly beyond surface 85) back to surface 83 or in close proximity thereto. With needle 59 fully withdrawn, a small hole 97 may remain in material 81 due to the needle penetration process, as will be explained further below.

In summation, the oscillating linear needle penetration cycle as set forth in detail above includes a partial penetration stroke $S_{F'}$, a partial withdrawal stroke $S_{R'}$, a full penetration stroke $S_{F''}$, and a full withdrawal stroke $S_{R''}$. Preferably, the length of partial penetration stroke $S_{F'}$ is approximately twice the length of partial withdrawal stroke $S_{R'}$.

For instance, in a preferred embodiment, partial penetration stroke $S_{F'}$ has a length of approximately 0.25 inches and, in turn, partial withdrawal stroke $S_{R'}$ has a length of approximately 0.12 inches. However, it is to be understood that the stroke lengths set forth above could be adjusted to suit the needs of the particular application (e.g., to accommodate different types and thicknesses of materials 81).

Features and Advantages of the Present Invention

The oscillating linear needle penetration cycle set forth in detail above introduces a notable advantage over traditional fastening methods. Specifically, it has been found that the use of a back-and-forth linear penetration motion minimizes the risk of lateral needle deflection (i.e., drifting of needle 59 from its ideal linear path). As a result, the oscillating linear needle penetration cycle as set forth above limits the likelihood of both (i) permanent bending or breakage of needle 59 as well as (ii) significant widening of hole 97. In fact, the aforementioned needle penetration cycle essentially renders hole 97 approximately equal in transverse cross-section to needle 59, thereby limiting the damage to material 81, which is a principal object of the present invention.

Design Modifications and Alternative Embodiments

The method described above is intended to be merely exemplary and those skilled in the art shall be able to make numerous variations and modifications to it without departing from the spirit of the present invention. All such variations and modifications are intended to be within the scope of the present invention as defined in the appended claims.

For instance, it should be noted that the material penetration method of the present invention is not limited to the four-stroke needle penetration cycle described in detail above (i.e., partial penetration, partial withdrawal, complete penetration, and complete withdrawal). Rather, it is to be understood that additional partial penetration and partial withdrawal strokes could be incorporated into the above-described needle penetration cycle, prior to the complete penetration step, in order to accommodate for materials of considerable thickness or density. For instance, utilizing a partial penetration stroke of 0.25 inches and a partial withdrawal stroke of 0.12 inches, the partial penetration and partial withdrawal component of the linear oscillating pattern could repeat multiple times, as necessary, until needle 59 fully penetrates the material (i.e., a first partial penetration of 0.25 inches, a first partial withdrawal of 0.12 inches, a second partial penetration of 0.25 inches, a second partial withdrawal of 0.12 inches, etc.).

It should also be noted that the material penetration method of the present invention is not limited to holding material fixed and, in turn, linearly driving needle through material (e.g., by programming a controller so as to operate the motor for the fastener dispensing device in accordance therewith). Rather, it is to be understood that the material penetration method of the present invention could be similarly applied by holding needle 59 stationary and, in turn, displacing material 81 linearly in relation to needle 59 using the above-described, oscillating linear path (e.g., by moving material 81 using a motor-driven stage).

What is claimed is:

1. A method for penetrating a material with a fastener dispensing needle, the material having a first surface and an opposing second surface, the fastener dispensing needle having a leading end with a sharpened tip, the method comprising the steps of:

(a) partially penetrating the material with the fastener dispensing needle using a first penetration stroke;

(b) after the partial penetration step, partially withdrawing the fastener dispensing needle from the material using a first withdrawal stroke; and (c) after the partial withdrawal step, fully penetrating the material with the fastener dispensing needle using a second penetration stroke.

2. The method as claimed in claim 1 wherein the first penetration stroke extends from the first surface of the material to a first location in the material between the first surface and the second surface.

3. The method as claimed in claim 2 wherein the first withdrawal stroke extends from the first location in the material to a second location in the material between the first surface and the first location.

4. The method as claimed in claim 3 wherein the second penetration stroke extends from the second location in the material to beyond the second surface.

5. The method as claimed in claim 1 further comprising the step of, between the partial withdrawal step using the first withdrawal stroke and the full penetration step using the second penetrations stroke, partially penetrating the material with the fastener dispensing needle using a third penetration stroke.

6. The method as claimed in claim 5 further comprising the step of, between the partial penetration step using the third penetration stroke and the full penetration step using the second penetration stroke, partially withdrawing the fastener dispensing needle from the material using a second withdrawal stroke.

7. The method as claimed in claim 6 wherein the full penetration step occurs immediately after the partial withdrawal step using a second withdrawal stroke.

8. The method as claimed in 1 wherein each of the first penetration stroke and the first withdrawal stroke has a length, the length of the first penetration stroke being approximately twice the length of the first withdrawal stroke.

9. The method as claimed in claim 8 wherein the first penetration stroke has a length of approximately 0.25 inches.

10. The method as claimed in claim 9 wherein the first withdrawal stroke has a length of approximately 0.12 inches.

11. The method as claimed in claim 1 wherein the fastener dispensing needle penetrates the material during the first penetration stroke along a first linear path.

12. The method as claimed in claim 11 wherein the fastener dispensing needle withdraws from the material during the first withdrawal stroke along the first linear path.

13. The method as claimed in claim 12 wherein the fastener dispensing needle penetrates the material during the second penetration stroke along the first linear path.

14. The method as claimed in claim 1 wherein, after the full penetration stroke, a fastener is dispensed from the fastener dispensing needle.

15. The method as claimed in claim 14 wherein, after the fastener dispensing step, the fastener dispensing needle is fully withdrawn from the material.

* * * * *